US005325112A

United States Patent [19]

Muto

[11] Patent Number: 5,325,112

[45] Date of Patent: Jun. 28, 1994

[54] INK JET RECORDING APPARATUS OF THE CONTINUOUS JET TYPE AND AUTOMATIC INK JET JETTING AXIS ADJUSTING METHOD OF THE SAME

[75] Inventor: Masayuki Muto, Machida, Japan

[73] Assignee: SR Technos Ltd.,, Higashiyamato, Japan

[21] Appl. No.: 19,675

[22] Filed: Feb. 19, 1993

[30] Foreign Application Priority Data

Mar. 2, 1992 [JP] Japan ..... 4-080517

[51] Int. Cl.[5] ..... B41J 2/02

[52] U.S. Cl. ..... 347/19; 347/74

[58] Field of Search ..... 346/75, 1.1

[56] References Cited

U.S. PATENT DOCUMENTS 3,916,421 10/1975 Hertz .
4,292,640 9/1981 Lammers et al. ..... 346/75
4,631,550 12/1986 Piatt et al. ..... 346/75 X
4,839,665 6/1989 Hertz et al. ..... 346/1.1

FOREIGN PATENT DOCUMENTS 2-1332 1/1990 Japan .

*Primary Examiner*—George H. Miller, Jr.
*Attorney, Agent, or Firm*—Cushman, Darby and Cushman

[57] ABSTRACT

An ink jet recording apparatus of the continuous jet type and an automatic ink jet jetting axis adjusting method of the same wherein the position of an ink jet jetting axis or nozzle axis can automatically be adjusted to an optimum position by a deflecting electric field are disclosed. When a carriage is at its home position, jetting of ink from a nozzle is started, and an MPU changes over a change-over switch to a test signal generator side. The test signal generator generates a test signal, which is a sum of an amplified recording signal and a bias potential outputted from a bias power source, and applies the test signal to a controlling electrode. The MPU checks an output of a current detector (jet current) based on charged ink drops caught by a conductive drop catcher to discriminate the positional relationship between an ink jet jetting axis and a knife edge. The MPU then changes the bias potential of the bias power source in accordance with a result of the discrimination. Consequently, the controlling signal applied to the controlling electrode is varied to adjust the ink jet jetting axis to its optimum position.

6 Claims, 4 Drawing Sheets

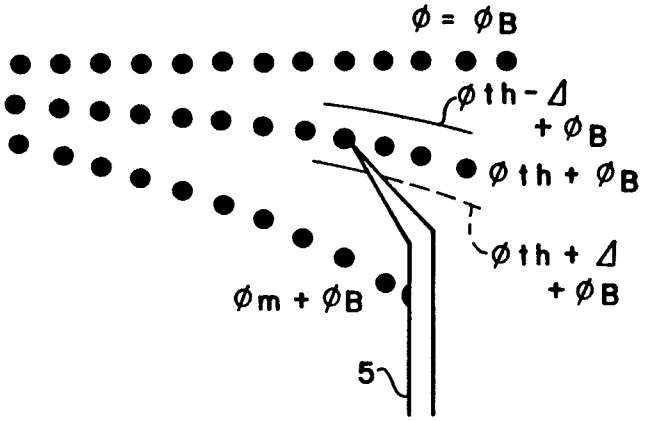
FIG. 2b
φ = φB
φth - Δ + φB
φth + φB
φth + Δ + φB
φm + φB
5
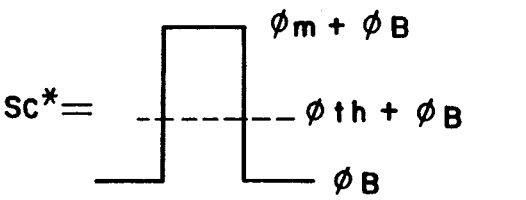
φm + φB
φth + φB
φB
Sc* =
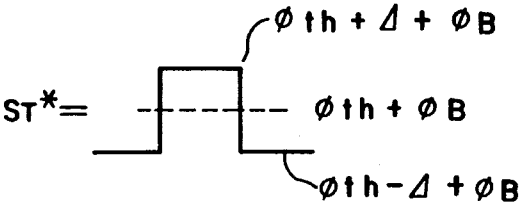
φth + Δ + φB
φth + φB
φth - Δ + φB
ST* =
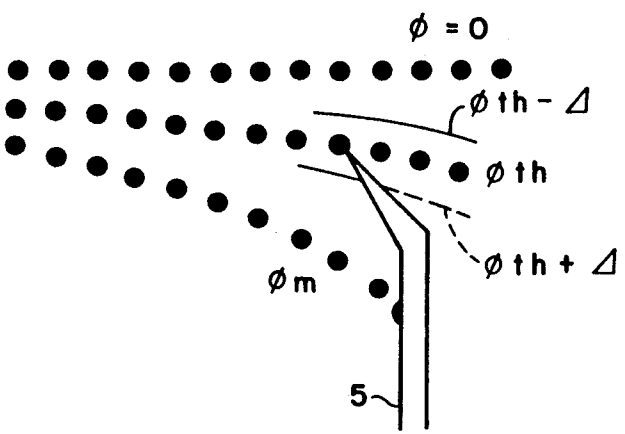
FIG. 2a
φ = 0
φth - Δ
φth
φth + Δ
φm
5
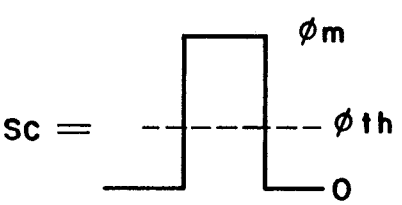
φm
φth
0
Sc =
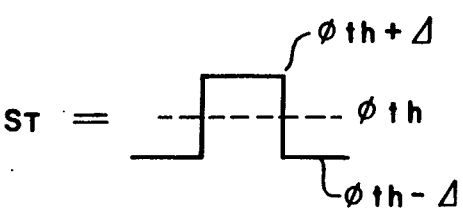
φth + Δ
φth
φth - Δ
ST =

INK JET RECORDING APPARATUS OF THE CONTINUOUS JET TYPE AND AUTOMATIC INK JET JETTING AXIS ADJUSTING METHOD OF THE SAME

BACKGROUND OF THE INVENTION

1. Field of the Invention

This invention relates to an ink jet recording apparatus of the continuous jet type and a method of automatically adjusting an ink jet jetting axis (nozzle axis) of a continuous jet type ink jet recording apparatus, and more particularly to a continuous jet type ink jet recording apparatus wherein a jet of ink jetted from a nozzle is selectively charged and deflected to record an image on a record medium and an automatic ink jet jetting axis adjusting method of the same.

2. Description of the Prior Art

Various ink jet recording apparatus of the continuous jet type are conventionally known and practically used. An exemplary one of such conventional continuous jet type ink jet recording apparatus is disclosed, for example, in U.S. Pat. No. 3,916,421 and shown in FIG. 4. Referring to FIG. 4, the continuous jet type ink jet recording apparatus shown is formed as an ink jet recording apparatus of the rotary drum type and includes, as principal components thereof, a nozzle 1 into which pressurized ink is supplied, an ink electrode 2 for holding the potential of ink in the nozzle 1 at the ground level, a controlling electrode 3 having a circular opening or a slit-like opening coaxial with the nozzle 1 and connected to receive a controlling signal Sc to control charging of a jet of ink, a grounding electrode 4 disposed in front of the controlling electrode 3 and grounded itself, a knife edge 5 mounted on the grounding electrode 4, a deflecting high voltage dc power source (hereinafter referred to as deflecting power source) 6, a deflecting electrode 7 connected to the deflecting power source 6 for cooperating with the grounding electrode 4 to produce therebetween an intense electric field perpendicular to an ink jet flying axis to deflect a charged ink drop to the grounding electrode 4 side, a recording signal generator SG connected to a host computer or a like signal source not shown for generating a recording signal, and a high voltage switch HVS for amplifying the voltage of the recording signal from the recording signal generator SG to produce a controlling signal Sc necessary for control of charging of an ink jet. An ink drop charged by the controlling electrode 3 is flown to a record medium RM wrapped around a rotary drum DR.

In such conventional continuous jet type ink jet recording apparatus, when a positive voltage is applied to the controlling electrode 3, an ink jet is charged with the negative charge and is disintegrated into a train of ink drops. When the ink drops charged with the negative charge pass a deflecting electric field generated by and between the controlling electrode 3 and the grounding electrode 4, they are reflected to the grounding electrode 4 side by the deflecting electrode 4 so that they are thereafter intercepted by the knife edge 5. On the other hand, when the voltage to the controlling electrode 3 is 0 volt, the ink jet is disintegrated into a train of ink drops while it is not charged, and consequently, the ink drops thereafter advance straightforwardly without being influenced by the deflecting electrode 7 so that the pass by the knife edge 5 and are recorded onto the record medium RM wrapped around the rotary drum DR.

Accordingly, it is apparent that the positional relationship between the ink jet jetting axis and the knife edge 5 is an important factor. In particular, the positional relationship must be such that ink drops charged and deflected be intercepted by the knife edge 5 but non-charged and straightforwardly advancing ink drops pass by the knife edge 4. Generally, the amount of deflection of a charged ink drop ranges 0.1 to 0.4 mm or so at the position of the knife edge 5. Accordingly, the positional relationship between the ink jet jetting axis and the knife edge 5 must be adjusted delicately.

Such adjustment of the positional relationship between the ink jet jetting axis (nozzle axis) and the knife edge is disclosed, for example, in Japanese Patent Laid-Open Application No. 1322/1990. The document discloses a continuous jet type ink jet recording apparatus wherein an ink jet jetting axis (nozzle axis) and a gutter member (corresponding to the knife edge 5) are movable relative to each other and adjustment of the positional relationship between them is performed by manual operation. When the relative position between an ink jet and the gutter member is to be adjusted, the substantial amount of deflection of the ink jet by the deflecting electric field is reduced (for example, to one half) comparing with that upon normal recording. Further, a charge amount detector is connected to the gutter member and the output of the charge amount detector is monitored so that it can be discriminated readily whether or not ink drops come to the gutter member.

In the conventional continuous jet type in jet recording apparatus, when the positional relationship between the ink jet and the gutter member is to be set and adjusted, the substantial amount of deflection of the ink jet by the deflecting electric field is reduced from that when normal recording is performed as described above. However, since the number of parameters of deflection upon adjustment is only one, there are drawbacks that it cannot be confirmed by what degree of accuracy the amount of deflection has been adjusted, that precise adjustment cannot be achieved unless the mechanical accuracy is high, that, if a high degree of mechanical accuracy is achieved, then the production cost of the product will increase as such, and so forth. Especially, while the gutter member must have an insulating structure when a charge amount detector is connected to the gutter member, since the gutter member is always exposed to ink, there is a problem that much difficulty and complication in structure are involved in such insulating structure.

Taking the foregoing into consideration, the inventor of the present invention has proposed, in Japanese Patent Laid-Open Application No. 151251/1992, a continuous jet type ink jet recording apparatus wherein, while a rotary drum and a carriage are held stopped with the carriage positioned in a region within which normal recording is not performed (such position of the carriage will be hereinafter referred to as home position), the continuous jet type ink jet recording apparatus is rendered operative to perform test printing in which an ink jet is jetted and deflected a little with respect to a middle point between two paths along which the ink jet follows when the deflecting electric field is operative and inoperative and the charge (electric current) carried by the ink jet having passed by the knife edge is detected to detect the position of the ink jet jetting axis (nozzle axis).

Another continuous jet type ink jet recording apparatus has also been proposed by the inventor of the present patent application and is disclosed in applicant's co-pending U.S. patent application Ser. No. 07/784,719 filed Oct. 30, 1991 and in applicant's Japanese Patent Laid-Open Application No. 173151/1992 wherein the continuous jet type ink jet recording apparatus is rendered operative to perform test printing wherein an ink jet is jetted and is subject to deflection which varies continuously or stepwise and the charge (electric current) carried by the ink jet having passed by the knife edge is detected to detect the position of an ink jet jetting axis (nozzle axis).

SUMMARY OF THE INVENTION

It is an object of the present invention to provide an ink jet recording apparatus of the continuous jet type and an automatic ink jet jetting axis adjusting method of the same wherein the position of an ink jet jetting axis or nozzle axis can automatically be adjusted to an optimum position by a deflecting electric field.

In order to attain the object described above, according to an aspect of the present invention, there is provided an ink jet recording apparatus of the continuous jet type, which comprises disintegrating means for jetting pressurized ink from a nozzle along an ink jet jetting axis to disintegrate the ink into a uniform train of ink drops, charging means for selectively charging the ink drops in accordance with a controlling signal, deflecting means for deflecting charged ones of the ink drops perpendicularly to the ink jet jetting axis, separating means for selectively intercepting the ink drops in accordance with the amount of deflection by the deflecting means, a bias power source for generating a bias potential, a high voltage switch for receiving and voltage amplifying a recording signal and adding the bias potential outputted from the bias power source to the amplified recording signal to produce a controlling signal, a test signal generator for adding the bias potential outputted from the bias power source to a first test signal having a level higher than 0 but lower than a voltage amplitude of the recording signal amplified by the high voltage switch to generate a second test signal, a change-over switch for selectively applying one of the controlling signal outputted from the high voltage switch and the second test signal outputted from the test signal generator as a controlling signal to the charging means, a conductive drop catcher disposed behind the separating means for catching those ink drops which have passed by the separating means, current detecting means connected to the conductive drop catcher for detecting the charge carried to the conductive drop catcher by the ink drops, and controlling means for controlling the bias potential to be outputted from the bias power source in accordance with an output of the current detecting means.

In the ink jet recording apparatus of the continuous jet type, pressurized ink is jetted along the ink jet jetting axis from the nozzle and is disintegrated into a uniform train of ink drops, and the charging means selectively charges the ink drops in accordance with a controlling signal. The deflecting means deflects charged ones of the ink drops perpendicularly to the ink jet jetting axis, and the separating means selectively intercepts the ink drops in accordance with the amount of deflection by the deflecting means. The bias power source generates a bias potential, and the high voltage switch receives and amplifies a recording signal by voltage amplification and adds the bias potential outputted from the bias power source to the amplified recording signal to produce a controlling signal. The test signal generator adds the bias potential outputted from the bias power source to a first test signal having a level higher than 0 but lower than a voltage amplitude of the recording signal amplified by the high voltage switch to generate a second test signal, and the change-over switch selectively applies one of the controlling signal outputted from the high voltage switch and the second test signal outputted from the test signal generator as a controlling signal to the charging means. The conductive drop catcher catches those ink drops which have passed by the separating means, and the current detecting means detects the charge carried to the conductive drop catcher by the ink drops. The controlling means controls the bias potential to be outputted from the bias power source in accordance with the output of the current detecting means.

With the ink jet recording apparatus of the continuous jet type, the positional relationship between the ink jet jetting axis and the knife edge can automatically be adjusted to its optimum position by applying the controlling signal, in which the bias voltage is included, to the charging means to effect adjustment of the ink jet jetting axis.

According to another aspect of the present invention, there is provided an ink jet recording apparatus of the continuous jet type, which comprises disintegrating means for jetting pressurized ink from a nozzle along an ink jet jetting axis to disintegrate the ink into a uniform train of ink drops, charging means for selectively charging the ink drops in accordance with a controlling signal, deflecting means for deflecting charged ones of the ink drops perpendicularly to the ink jet jetting axis, separating means for selectively intercepting the ink drops in accordance with the amount of deflection by the deflecting means, a bias power source for generating a bias potential to be applied to the ink in the disintegrating means, a high voltage switch for receiving and amplifying a recording signal by voltage amplification to produce a controlling signal, a test signal generator for generating a test signal having a level higher than 0 but lower than a voltage amplitude of the controlling signal outputted from the high voltage switch, a change-over switch for selectively applying one of the controlling signal outputted from the high voltage switch and the test signal outputted from the test signal generator as a controlling signal to the charging means, a conductive drop catcher disposed behind the separating means for catching those ink drops which have passed by the separating means, current detecting means connected to the conductive drop catcher for detecting the charge carried to the conductive drop catcher by the ink drops, and controlling means for controlling the bias potential to be outputted from the bias power source in accordance with an output of the current detecting means.

In the ink jet recording apparatus of the continuous jet type, pressurized ink is jetted from the nozzle along the ink jet jetting axis and is disintegrated into a uniform train of ink drops, and the charging means selectively charges the ink drops in accordance with a controlling signal. The deflecting means deflects charged ones of the ink drops perpendicularly to the ink jet jetting axis, and the separating means selectively intercepts the ink drops in accordance with the amount of deflection by the deflecting means. The bias power source generates a bias potential to be applied to the ink in the disintegrating means, and the high voltage switch receives and amplifies a recording signal by voltage amplification to produce a controlling signal. The test signal generator generates a test signal having a level higher than 0 but lower than a voltage amplitude of the controlling signal outputted from the high voltage switch, and the change-over switch selectively applied one of the controlling signal outputted from the high voltage switch and the test signal outputted from the test signal generator as a controlling signal to the charging means. The conductive drop catcher catches those ink drops which have passed by the separating means, and the current detecting means detects the charge carried to the conductive drop catcher by the ink drops. The controlling means controls the bias potential to be outputted from the bias power source in accordance with the output of the current detecting means.

With the ink jet recording apparatus of the continuous jet type, the positional relationship between the ink jet jetting axis and the knife edge can automatically be adjusted to its optimum position by applying the bias potential to ink of the disintegrating means to effect adjustment of the ink jet jetting axis.

According to a further aspect of the present invention, there is provided an automatic ink jet jetting axis adjusting method, which comprises the steps of detecting a jet current while a first test signal which is a sum of a bias potential and a second test signal having a first level higher than 0 but lower than a voltage amplitude of a controlling signal is applied to charging means, detecting a jet current while a third test signal which is a sum of the bias potential and a fourth test signal having a second level higher than 0 but lower than the voltage amplitude of the controlling signal is applied to the charging means, changing, when a jet current is detected at both or neither of the first and second detecting steps, the bias potential and repeating the first and second detecting steps, and fixing, when a jet current is detected at only either one of the first and second detecting steps, the bias potential.

In the automatic ink jet jetting axis adjusting method, at the first step, a jet current is detected while the first test signal which is a sum of the bias potential and the second test signal having the first level higher than 0 but lower than the voltage amplitude of the controlling signal is applied to the charging means. Then at the second step, a jet current is detected while the third test signal which is a sum of the bias potential and the fourth test signal having the second level higher than 0 but lower than the voltage amplitude of the controlling signal is applied to the charging means. Then, when a jet current is detected at both or neither of the first and second detecting steps, the bias potential is changed, and then, the first and second detecting steps are repeated. But when a jet current is detected at only either one of the first and second detecting steps, the bias potential is fixed.

With the automatic ink jet jetting axis adjusting method, the bias potential with which an optimum position of the ink jet jetting axis can be obtained can be determined readily by measuring the jet current while the first test signal which is a sum of the bias potential and the second test signal having the first level higher than 0 but lower than the voltage amplitude of the controlling signal and then the third test signal which is a sum of the bias potential and the fourth test signal having the second level higher than 0 but lower than the voltage amplitude of the controlling signal are successively applied to the charging means.

According to a still further aspect of the present invention, there is provided an automatic ink jet jetting axis adjusting method, which comprises the steps of detecting a jet current while a first test signal having a first level higher than 0 but lower than a voltage amplitude of a controlling signal is applied to charging means and a bias potential is applied to ink of disintegrating means, detecting a jet current while a second test signal having a second level higher than 0 but lower than the voltage amplitude of the controlling signal is applied to the charging means and the bias potential is applied to the ink of the disintegrating means, changing, when a jet current is detected at both or neither of the first and second detecting steps, the bias potential and repeating the first and second detecting steps, and fixing, when a jet current is detected at only either one of the first and second detecting steps, the bias potential.

In the automatic ink jet jetting axis adjusting method, at the first step, a jet current is detected while the first test having the first level higher than 0 but lower than the voltage amplitude of the controlling signal is applied to the charging means and the bias potential is applied to ink of the disintegrating means. Then at the second step, a jet current is detected while the second test signal having the second level higher than 0 but lower than the voltage amplitude of the controlling signal is applied to the charging means and the bias potential is applied to the ink of the disintegrating means. Then, when a jet current is detected at both or neither of the first and second detecting steps, the bias potential is changed, and then, the first and second detecting steps are repeated. But when a jet current is detected at only either one of the first and second detecting steps, the bias potential is fixed.

With the automatic ink jet jetting axis adjusting method, the bias potential with which an optimum position of the ink jet jetting axis can be obtained can be determined readily by measuring the jet current while the first test signal having the first level higher than 0 but lower than the voltage amplitude of the controlling signal and then the second test signal having the second level higher than 0 but lower than the voltage amplitude of the controlling signal are successively applied to the charging means with the bias potential applied to the ink of the disintegrating means.

The above and other objects, features and advantages of the present invention will become apparent from the following description and the appended claims, taken in conjunction with the accompanying drawings in which like parts or elements are denoted by like reference characters.

BRIEF DESCRIPTION OF THE DRAWINGS

FIGS. 2*a* and 2*b* are schematic views illustrating the principle of an automatic ink jet jetting axis adjusting method of the present invention;

DESCRIPTION OF THE PREFERRED EMBODIMENTS

Figure 1:
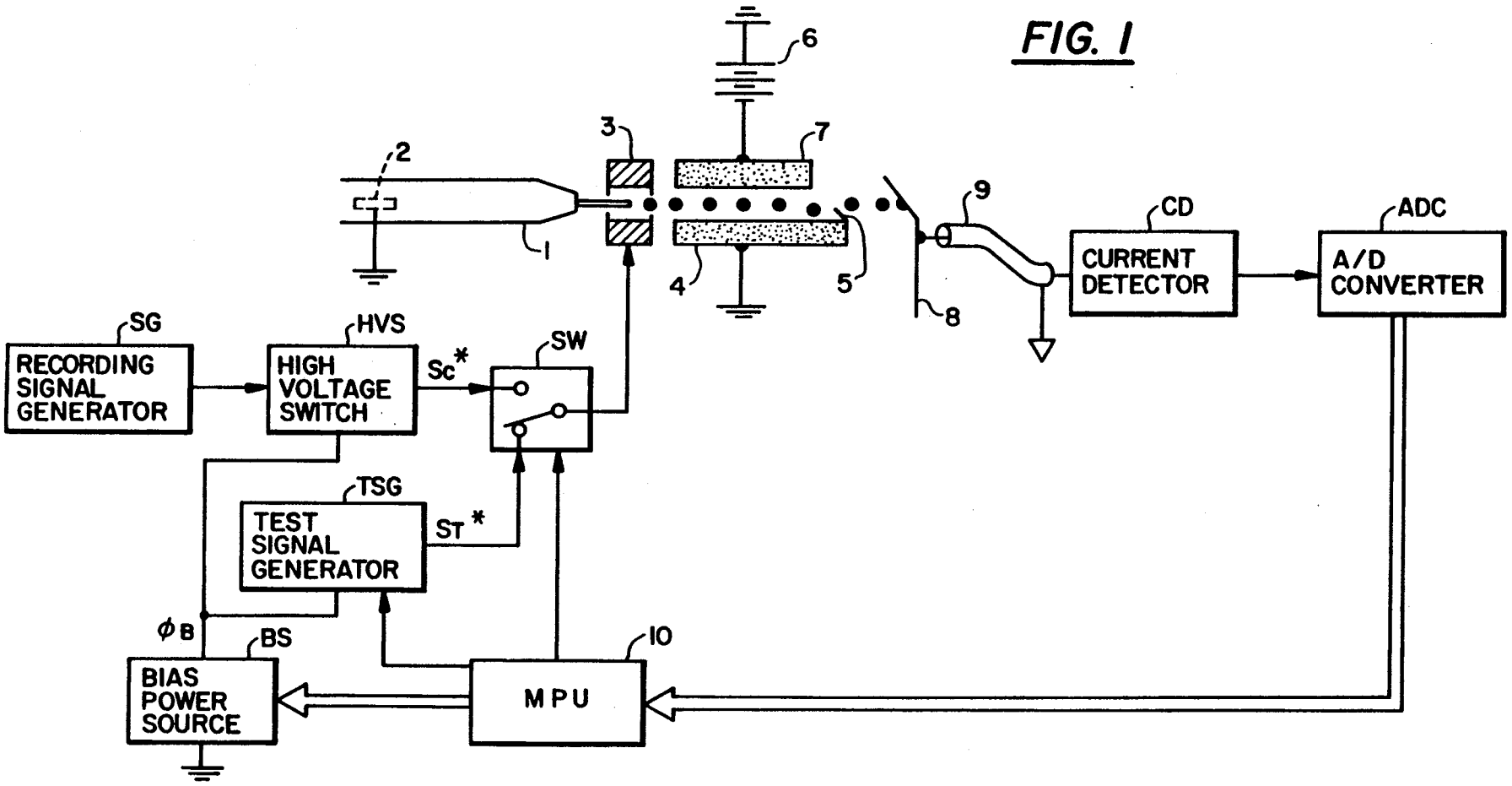
FIG. 1 is a diagrammatic representation of a continuous jet type ink jet recording apparatus showing a first preferred embodiment of the present invention.

Referring first to FIG. 1, there is shown an ink jet recording apparatus of the continuous jet type to which the present invention is applied. The continuous jet type ink jet recording apparatus of the present embodiment includes a nozzle 1 having an orifice having a very small diameter for jetting a jet of ink along an ink jet jetting axis or nozzle axis, an ink electrode 2 for holding the potential of ink in the nozzle 1 at the ground level, a controlling electrode 3 having a circular opening or a slit-like opening coaxial with the nozzle 1 and connected to receive a controlling signal to control charging of a jet of ink passing the opening therein in accordance with a recording signal, a grounding electrode 4 disposed in front of the controlling electrode 3 and grounded itself, a knife edge 5 mounted on the grounding electrode 4, a deflecting high voltage dc power source (hereinafter referred to as deflecting power source) 6, a deflecting electrode 7 connected to the deflecting power source 6 for cooperating with the grounding electrode 4 to produce therebetween an intense electric field perpendicular to the ink jet flying axis to deflect a charged ink drop to the grounding electrode 4 side, a conductive drop catcher 8 disposed at a home position of a carriage (not shown), on which the nozzle 1 is carried, in front of the grounding electrode 4 and the deflecting electrode 7 and serving also as a detecting electrode, a shielding line 9 connected to the conductive drop catcher 8, a current detector CD connected to the shielding line 9, an analog to digital (A/D) converter ADC connected to the current detector CD, a signal generator SG for generating a recording signal, a high voltage switch HVS for amplifying the voltage of the recording signal from the signal generator SG to produce a controlling signal Sc*, a test signal generator TSG for generating a test signal St*, a change-over switch SW for applying one of the controlling signal Sc* and the test signal St* as a controlling signal to the controlling electrode 3, a bias power source BS for applying a bias potential $\phi B$ to the high voltage HVS and the test signal generator TSG, a test signal generator TSG for generating a test signal in accordance with the output of the analog to digital converter ADC, and a microprocessor (MPU) 10 serving as controlling means for controlling the change-over switch SW and the bias power source BS. It is to be noted that, in FIG. 1, like components to those of the conventional continuous jet type ink jet recording apparatus shown in FIG. 4 are denoted by like reference characters (this similarly applies to the embodiment shown in FIG. 3).

When the carriage (not shown) on which the nozzle 1 is carried at the home position, the conductive drop catcher 8 is positioned behind the knife edge 5 in an opposing relationship to a rotary drum (not shown). The conductive drop catcher 8 is electrically insulated from any other element except that it is connected to the input of the current detector CD by way of the shielding line 9. The output of the current detector CD is connected to the analog to digital converter ADC. The analog to digital converter ADC may be replaced by a comparator. The digital output of the analog to digital converter ADC is connected to a data bus of the MPU 10 by way of a suitable interface not shown.

The test signal generator TSG outputs a test signal St* having such a waveform as shown in FIG. 2*a* in response to an instruction from the MPU 10. The bias power source BS is connected to the test signal generator TSG and the high voltage switch HVS.

The bias power source BS may be formed from a digital to analog converter and is connected to another data bus of the MPU 10 by way of another suitable interface not shown. The bias power source BS provides a bias potential $\phi B$ to the high voltage switch HVS and the test signal generator TSG.

The high voltage switch HVS amplifies a recording signal outputted from the recording signal generator SG to obtain a controlling signal Sc, adds the bias potential $\phi B$ to the controlling signal Sc to obtain a controlling signal Sc*, and outputs the controlling signal Sc* (refer to FIG. 2*b*).

The test signal generator TSG produces a test signal having a level higher than 0 volt but lower than a voltage amplitude $\phi m$ of the controlling signal Sc, adds the bias potential $\phi b$ to the test signal St to obtain a test signal St* and outputs the test signal St*. It is to be noted that the test signal St can have two two levels including a first level $\phi t\ h-\Delta$ and a second level $\phi t\ h+\Delta$ (refer to FIG. 2*a*), where $\phi t\ h$ is a threshold level, and $\Delta$ is an allowable error.

The controlling signal Sc* outputted from the high voltage switch HVS and the test signal St* outputted from the test signal generator TSG are coupled to a pair of input terminals of the change-over switch SW, and the common output terminal of the change-over switch SW is connected to the controlling electrode 3. The change-over switch SW operates in response to an instruction from the MPU 10 to connect a selected one of the controlling signal Sc* and the test signal St* to the controlling electrode 3.

FIG. 2*a* illustrates the relationship of the ink jet jetting axis in the neighborhood of the knife edge 5 to the controlling signal Sc (having an voltage amplitude $\phi m$) and the test signal St. The threshold level $\phi t\ h$ has a value satisfying $0<\phi t\ h<\phi m$, and preferably, when $\phi=\phi t\ h$, the ink jet jetting axis coincides with the terminal end of the knife edge 5 as seen from FIG. 2*a*. However, in the continuous jet type ink jet recording apparatus, $\phi t\ h\pm\Delta$ is allowable. Whether the extremity of the knife edge 5 is included within the range of the variation of the ink jet jetting axis defined by $\phi t\ h-\Delta<\phi<\phi t\ h+\Delta$ can be examined by charging the ink jet in accordance with the test signal St. In particular, if ink drops pass by the knife edge 5 when $\phi=\phi th-\Delta$ but ink drops are intercepted by the knife edge 5 when $\phi=\phi t\ h+\Delta$, then the extremity of the knife edge 5 is included within the range of the variation of the ink jet jetting axis. Since the ink drops are charged in either case, if the charge can be measured, then the position of the ink jet jetting axis can be detected.

While the threshold level $\phi t\ h$ is a value determined experimentally so that a printed image may present the best quality, the control margin is maximum when $\phi t\ h=\phi m/2$. While the allowable error $\Delta$ relies upon the S/N ratio of the current detecting system, suitably $\Delta\approx(1/10 \text{ to } 1/5)\phi m$.

FIG. 2*b* illustrates the principle of adjustment when the ink jet jetting axis is displaced so that the extremity of the knife edge 5 goes out of the range of the variation of the ink jet jetting axis of $\phi t\ h-\Delta<\phi<\phi t\ h+\Delta$. In such an instance, if the bias potential $\phi B$ is added to the controlling signal Sc and the test signal St to convert them into a controlling signal Sc* and a test signal St*, respectively, and the bias potential $\phi B$ is adjusted, then the entire ink jet jetting axis is shifted parallelly relative to the knife edge 5 by an action of the deflecting electric field. Consequently, if the bias potential $\phi B$ is adjusted to a suitable value, then the positional relationship between the knife edge 5 and the ink jet jetting axis can be adjusted to such an optical position as shown in FIG. 2*b*.

In the continuous jet type ink jet recording apparatus of the present embodiment, the controlling signal Sc whose voltage amplitude $\phi m$ varies within the range of 30 volts $\leqq \phi m \leqq 100$ volts is used. In this instance, it is effective for the bias potential $\phi B$ to have a value within the range of $-500$ volts $\leqq \phi B \leqq 50$ volts.

Subsequently, operation of the continuous jet type ink jet recording apparatus having such construction as described above and an automatic ink jet jetting axis adjusting method for the continuous jet type ink jet recording apparatus will be described.

(1) First, the carriage is positioned to its home position, and jetting of an ink jet from the nozzle 1 is started. The MPU 10 connects the change-over switch SW to the test signal generator TSG side so that a test signal St outputted from the test signal generator TSG may be applied to the controlling electrode 3.

(2) The MPU 10 delivers an instruction so that the test signal generator TSG alternately generates a test signal St, that is, two level voltages of the first level $\phi t\ h-\Delta$ and the second level $\phi t\ h+\Delta$.

(3) The MPU 10 checks the output of the analog to digital converter ADC (to detect presence or absence or a jet current) to measure whether a train of ink drops charged with the alternate voltages of $\phi t\ h-\Delta$ and $\phi t\ h+\Delta$ and thus deflected pass by or are intercepted by the knife edge 5, and discriminates the positional relationship of the ink jet jetting axis to the knife edge 5 based on a result of the measurement. In particular, (a) when no jet current is detected at any of the voltages of $\phi t\ h-\Delta$ and $\phi t\ h+\Delta$, both of ink drops which are deflected by a comparatively large amount and ink drops which are deflected by a comparatively small amount (or are not deflected) are intercepted by the knife edge 5, and accordingly, the ink jet jetting axis must be corrected upwardly; (b) when a jet current is detected at both of the voltages of $\phi t\ h-\Delta$ and $\phi t\ h+\Delta$, both of ink drops which are deflected by a comparatively large amount and ink drops which are deflected by a comparatively small amount (or are not deflected) pass by the knife edge 5, and accordingly, the ink jet jetting axis must be corrected downwardly; and (c) when a jet current flows at the voltage of $\phi t\ h-\Delta$ but not jet current flows at the other voltage of $\phi t\ h+\Delta$, ink drops which are deflected by a comparatively large amount are intercepted by the knife edge 5 whereas ink drops which are deflected by a comparatively small amount (or are not defected) pass by the knife edge 5, and accordingly, the ink jet jetting axis is at its appropriate position and must not be displaced.

(4) The MPU 10 adjusts the bias potential $\phi B$, which is the output of the bias power source BS, based on a result of the discrimination at the step (3) above. The MPU 10 sends out the data to the bias power source BS by way of the data bus, and the bias power source BS converts the data into a bias potential $\phi B$ by digital to analog conversion.

In particular, when the MPU 10 discriminates the first case (a) above, it causes the bias power source BS to successively output negative bias potentials $\phi B1$, $\phi B2$, . . .which increase stepwise or continuously while it detects presence or absence of a jet current at the voltages of $\phi t\ h-\Delta+\phi B$ and $\phi t\ h+\Delta+\phi b$, and it repeats such discrimination of the ink jet jetting axis similar to the step (3) described above. Then, when it finds out a bias potential $\phi B$ a with which no jet current is detected any more at the second level of $\phi t\ h+\Delta+\phi b$ a. It fixes the bias potential $\phi B$ to the value $\phi B$ a. It is to be noted that the process of searching such potential value $\phi B$ a is programmed as firmware in advance in the MPU 10.

On the other hand, when the MPU 10 discriminates the second case (b), it cause the bias power source BS to successively output positive bias potential $\phi B1$, $\phi B2$, . . .which increase stepwise or continuously while it operates in a similar manner as in the discrimination (a). Thus, the MPU 10 finally fixes the bias potential $\phi B$.

However, when the MPU 10 discriminates the third case (c), it immediately fixes the bias potential $\phi B$ to $\phi B=0$.

(5) Subsequently, the MPU 10 changes over the input terminal of the change-over switch SW from the test signal generator TSG side to the high voltage switch HVS side and then executes an an ordinary printing operation. In particular, rotation of the rotary drum and translation of the carriage are started, and a recording signal generated from the recording signal generator TSG is first amplified by the high voltage switch HVS by voltage amplification. A bias potential $\phi B$ from the bias power source BS is added to the recording signal from the high voltage switch HVS to form a controlling signal Sc*, which is then applied to the controlling electrode 3 by way of the change-over switch SW. Meanwhile, ink is jetted from the nozzle 1 and disintegrated into ink drops. The ink drops are charged by and under the control of the controlling electrode 3, and then, those ink drops which have been charged strong are deflected by a great amount toward the grounding electrode 4 side by the deflecting electric field and are thus intercepted by the knife edge 5. Meanwhile, those ink drops which have been charged weak (or have not been charge) pass by the knife edge 5 and are recorded onto a record medium (not shown) wrapped around the rotary drum. In this instance, the ink drops follow the ink jet jetting axis which has automatically been adjusted to its optimum position as described above.

Figure 3:
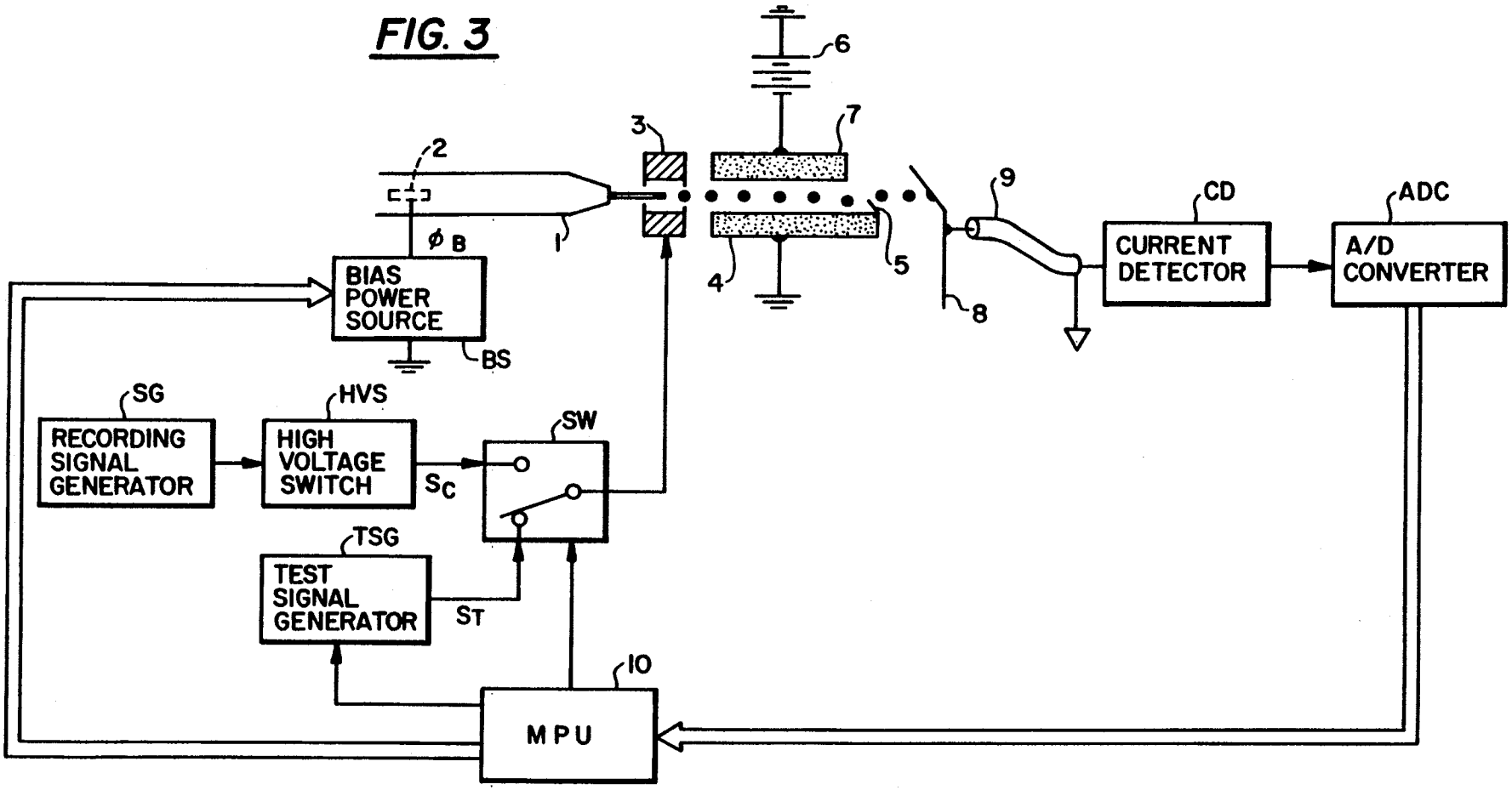
FIG. 3 is a diagrammatic representation of another continuous jet type ink jet recording apparatus showing a second preferred embodiment of the present invention.
Figure 4:
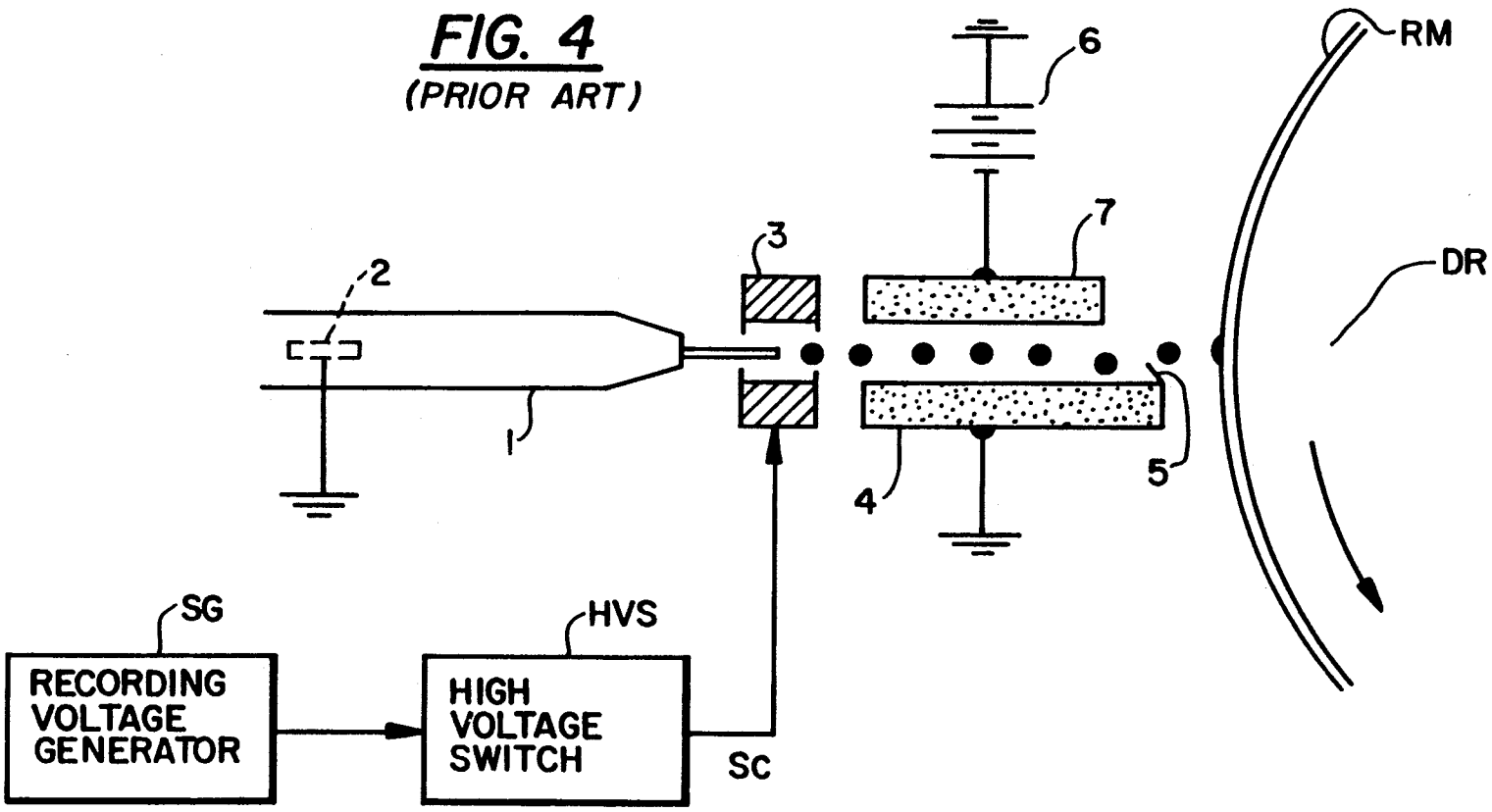
FIG. 4 (PRIOR ART)
FIG. 4 is a diagrammatic representation showing a conventional continuous jet type ink jet recording apparatus of the rotary drum type.

Referring now to FIGS. 3, there is shown an ink jet recording apparatus of the continuous jet type according to a second preferred embodiment of the present invention. The continuous jet type ink jet recording apparatus of the present embodiment is a modification to and is different from the continuous jet type ink jet recording apparatus of the first embodiment only in that the bias power source BS is connected to the ink electrode 2 while the bias power source BS in the first embodiment is connected to the high voltage switch HVS and the test signal generator TSG. With the modified structure, the high voltage switch HVS and the test signal TSG can be constructed simple. It is to be noted that an insulating structure must be provided around the nozzle 1.

In the continuous jet type ink jet recording apparatus of the second embodiment having such construction as described just above, since a bias potential $\phi B$ is applied directly to ink, or in other words, since the bias potential $\phi B$ is not reflected as a factor of the opposite polarity to that of induction charging by a test signal St* and a controlling signal Sc* as in the continuous jet type ink jet recording apparatus of the first embodiment, upon automatic adjustment of the ink jet jetting axis, a positive potential $\phi B$ is used when the result of the discrimination is the case (a) whereas a negative potential $\phi B$ is used when the result of the discrimination is the case (b), which is a significant difference of the continuous jet type ink jet recording apparatus of the present embodiment from the continuous jet type ink jet recording apparatus of the first embodiment. Except this, the continuous jet type ink jet recording apparatus of the present embodiment operates in a similar manner as the continuous jet type ink jet recording apparatus of the first embodiment. Accordingly, detailed description of operation of the continuous jet type ink jet recording apparatus of the present embodiment is omitted herein to avoid redundancy.

By the way, the jet current (charge carried by a charged ink jet) is very weak, and accordingly, the current detector CD is required to have a high current detecting capacity of 1 to 10 nA. The integrator proposed in Japanese Patent Laid-Open Application No. 151251/1992 or No. 173151/1992 by the inventor of the present invention can be used effectively as such weak current detector.

It is to be noted that, while the present invention is applied, in the first and second embodiments, to a continuous jet type ink jet recording apparatus of the Hertz type wherein drops of ink charged strong are removed while drops of ink charged weak (or drops of ink not charged) are used to record, naturally the present invention can be applied similarly to another continuous jet type ink jet recording apparatus of the binary deflection Sweet type wherein drops of ink charged weak (or drops of ink not charged) are intercepted by a knife edge while drops of ink charged strong are used to record.

Having now fully described the invention, it will be apparent to one of ordinary skill in the art that many changes and modifications can be made thereto without departing rom the spirit and scope of the invention as set forth herein.

What is claimed is:

1. An ink jet recording apparatus of the continuous jet type, comprising:

disintegrating means for jetting pressurized ink from a nozzle along an ink jet jetting axis to disintegrate the ink into a uniform train of ink drops;

charging means for selectively charging the ink drops in accordance with a controlling signal;

deflecting means for deflecting charged ones of the ink drops perpendicularly to the ink jet jetting axis;

separating means for selectively intercepting the ink drops in accordance with the amount of deflection by said deflecting means;

a bias power source for generating a bias potential;

a high voltage switch for receiving and voltage amplifying a recording signal and adding the bias potential outputted from said bias power source to the amplified recording signal to produce a controlling signal;

a test signal generator for adding the bias potential outputted from said bias power source to a first test signal having a level higher than 0 but lower than a voltage amplitude of the recording signal amplified by said high voltage switch to generate a second test signal;

a change-over switch for selectively applying one of the controlling signal outputted from said high voltage switch and the second test signal outputted from said test signal generator as a controlling signal to said charging means;

a conductive drop catcher disposed behind said separating means for catching those ink drops which have passed by said separating means;

current detecting means connected to said conductive drop catcher for detecting the charge carried to said conductive drop catcher by the ink drops; and controlling means for controlling the bias potential to be outputted from said bias power source in accordance with an output of said current detecting means.

2. An ink jet recording apparatus of the continuous jet type as claimed in claim 1, wherein the second test signal generated from said test signal generator has two levels higher than 0 and individually equal to values obtained by subtracting and adding a predetermined value from and to the voltage amplitude of the controlling signal.

3. An ink jet recording apparatus of the continuous jet type, comprising:

disintegrating means for jetting pressurized ink from a nozzle along an ink jet jetting axis to disintegrate the ink into a uniform train of ink drops;

charging means for selectively charging the ink drops in accordance with a controlling signal;

deflecting means for deflecting charged ones of the ink drops perpendicularly to the ink jet jetting axis;

separating means for selectively intercepting the ink drops in accordance with the amount of deflection by said deflecting means;

a bias power source for generating a bias potential to be applied to the ink in said disintegrating means;

a high voltage switch for receiving and amplifying a recording signal by voltage amplification to produce a controlling signal;

a test signal generator for generating a test signal having a level higher than 0 but lower than a voltage amplitude of the controlling signal outputted from said high voltage switch;

a change-over switch for selectively applying one of the controlling signal outputted from said high voltage switch and the test signal outputted from said test signal generator as a controlling signal to said charging means;

a conductive drop catcher disposed behind said separating means for catching those ink drops which have passed by said separating means;

current detecting means connected to said conductive drop catcher for detecting the charge carried to said conductive drop catcher by the ink drops; and controlling means for controlling the bias potential to be outputted from said bias power source in accordance with an output of said current detecting means.

4. An ink jet recording apparatus of the continuous jet type as claimed in claim 3, wherein the test signal generated from said test signal generator has two levels higher than 0 and individually equal to values obtained by subtracting and adding a predetermined value from and to the voltage amplitude of the controlling signal.

5. An automatic ink jet jetting axis adjusting method for controlling the jetting axis of a train of ink drops, comprising the steps of:

detecting a jet current while a first test signal which is a sum of a bias potential and a second test signal having a first level higher than 0 but lower than a voltage amplitude of a controlling signal is applied to a charging means that selectively charges ink drops in a train of ink drops;

detecting a jet current while a third test signal which is a sum of the bias potential and a fourth test signal having a second level higher than 0 but lower than the voltage amplitude of the controlling signal is applied to the charging means;

changing, when a jet current is detected at both or neither of the first and second detecting steps, the bias potential and repeating the first and second detecting steps; and fixing, when a jet current is detected at only either one of the first and second detecting steps, the bias potential.

6. An automatic ink jet jetting axis adjusting method for controlling the jetting axis of a train of ink drops, comprising the steps of:

detecting a jet current while a first test signal having a first level higher than 0 but lower than a voltage amplitude of a controlling signal is applied to a charging means that selectively charges ink drops in a train of ink drops and a bias potential is applied to an ink disintegrating means;

detecting a jet current while a second test signal having a second level higher than 0 but lower than the voltage amplitude of the controlling signal is applied to the charging means and the bias potential is applied to the ink of the disintegrating means;

changing, when a jet current is detected at both or neither of the first and second detecting steps, the bias potential and repeating the first and second detecting steps; and fixing, when a jet current is detected at only either one of the first and second detecting steps, the bias potential.

* * * * *